US012662995B2

(12) United States Patent
Voser et al.

(10) Patent No.: US 12,662,995 B2
(45) Date of Patent: Jun. 23, 2026

(54) PISTON COMPRESSOR AND METHOD OF OPERATING THE SAME

(71) Applicant: BURCKHARDT COMPRESSION AG, Winterthur (CH)

(72) Inventors: Alexandre Voser, Elsau (CH); Reiner Schulz, Lottstetten (DE); Sandro Brunner, Winterthur (CH)

(73) Assignee: BURCKHARDT COMPRESSION AG, Winterthur (CH)

( * ) Notice: Subject to any disclaimer, the term of this patent is extended or adjusted under 35 U.S.C. 154(b) by 127 days.

(21) Appl. No.: 18/668,654

(22) Filed: May 20, 2024

(65) Prior Publication Data

US 2024/0309859 A1 Sep. 19, 2024

Related U.S. Application Data

(63) Continuation of application No. 17/279,402, filed as application No. PCT/EP2019/075775 on Sep. 25, 2019, now abandoned.

(30) Foreign Application Priority Data

Sep. 24, 2018 (EP) ..... 18196409

(51) Int. Cl.
*F04B 5/02* (2006.01)
*F04B 9/04* (2006.01)
(Continued)

(52) U.S. Cl.
CPC ..... *F04B 5/02* (2013.01); *F04B 15/08* (2013.01); *F04B 53/08* (2013.01); *F04B 53/14* (2013.01);
(Continued)

(58) Field of Classification Search
CPC .. F04B 5/02; F04B 15/08; F04B 53/08; F04B 53/14; F04B 53/146; F04B 53/16;
(Continued)

(56) References Cited

U.S. PATENT DOCUMENTS 1,596,037 A 8/1926 Clarence
2,695,132 A 11/1954 Paget
(Continued)

FOREIGN PATENT DOCUMENTS

EP 2592269 A1 5/2013
FR 1030140 A 6/1953
WO 2009112479 A1 9/2009

OTHER PUBLICATIONS

International Search Report for Application No. PCT/EP2019/075775, dated Nov. 22, 2019, 8 Pages (including English Translation).

(Continued)

*Primary Examiner* — Hoang M Nguyen
(74) *Attorney, Agent, or Firm* — Brooks Kushman P.C.

(57) ABSTRACT

A method of operating a piston compressor the compressor having a cylinder as well as a piston arranged therein, a carrier housing with a crosshead mounted in the carrier housing, a spacer which connects the cylinder to the carrier housing, as well as a piston rod extending in a longitudinal direction (L) which connects the crosshead to the piston, wherein the spacer has a plurality of support arms, wherein the support arms are connected to and support the cylinder. The method supplies an inlet fluid (FE) at a temperature in the range between −162° C. and −40° C. to the cylinder via the inlet valve, and expels the fluid located in the cylinder via the outlet valve, wherein the outlet fluid (FA) is heated in the cylinder by compression by a temperature difference in the range between 100° C. and 150° C.

14 Claims, 5 Drawing Sheets

(51) Int. Cl.

| | |
|---|---|
| ***F04B 15/08*** | (2006.01) |
| ***F04B 19/22*** | (2006.01) |
| ***F04B 23/06*** | (2006.01) |
| ***F04B 53/08*** | (2006.01) |
| ***F04B 53/14*** | (2006.01) |
| ***F04B 53/16*** | (2006.01) |

(52) U.S. Cl.
CPC ..... *F04B 53/146* (2013.01); *F04B 53/16* (2013.01); *F04B 9/042* (2013.01); *F04B 19/22* (2013.01); *F04B 23/06* (2013.01)

(58) Field of Classification Search
CPC ..... F04B 9/042; F04B 19/22; F04B 23/06; F04B 2015/081
See application file for complete search history.

(56) References Cited

U.S. PATENT DOCUMENTS

| | | | | |
|---|---|---|---|---|
| 3,632,237 | A | 1/1972 | Nelson | |
| 4,140,442 | A | 2/1979 | Mulvey | |
| 4,347,046 | A | 8/1982 | Brucken | |
| 4,494,415 | A | 1/1985 | Elliston | |
| 4,576,557 | A | 3/1986 | Pevzner | |
| 5,239,551 | A | 8/1993 | Roberts | |
| 8,821,132 | B2 * | 9/2014 | Fejzuli | F04B 39/06 417/258 |
| 11,454,231 | B2 * | 9/2022 | Prodan | F04B 39/122 |
| 2010/0275774 | A1 * | 11/2010 | Clemens | F16J 1/14 384/243 |
| 2011/0103976 | A1 | 5/2011 | Fejzuli | |
| 2012/0152110 | A1 | 6/2012 | Kabir | |
| 2016/0245274 | A1 | 8/2016 | Nagura | |
| 2017/0218935 | A1 * | 8/2017 | Weilenmann | F04B 53/162 |
| 2018/0245574 | A1 | 8/2018 | Frefel | |
| 2020/0386218 | A1 * | 12/2020 | Feistel | F16J 15/26 |
| 2025/0027489 | A1 * | 1/2025 | Cappelli | F04B 51/00 |

OTHER PUBLICATIONS

Connected Definition & Meaning—Merriam -Webster, from merriam-webster.com/dictionary/connected (Year: 2024).
Attached Definition & Meaning—Merriam-Webster, from merriam-webster.com/dictionary/attached (Year: 2024).

* cited by examiner

PISTON COMPRESSOR AND METHOD OF OPERATING THE SAME

CROSS-REFERENCE TO RELATED APPLICATIONS

This application is a Continuation of U.S. application Ser. No. 17/279,402 filed Mar. 24, 2021 which is the U.S. national phase of PCT Application No. PCT/EP2019/075775 filed on Sep. 25, 2019, which claims priority to European Patent Application No. 18196409.9 filed on Sep. 24, 2018, which are incorporated herein by reference in their entireties.

TECHNICAL FIELD

The invention relates to a method of operating a reciprocating compressor.

BACKGROUND

Liquefied natural gas, also referred to as "liquefied natural gas" or "LNG" for short, is natural gas that has been cooled to a temperature of at least −160° C. and that assumes a liquid aggregate state at these low temperatures. WO 2009/112479A1 discloses a reciprocating compressor for providing natural gas fuel, wherein said natural gas fuel is obtained by compressing exhaust gas discharged from liquid natural gas by means of the reciprocating compressor. Such a piston compressor, which in itself is very well proven, allows the exhaust gas of the liquid natural gas, which usually has a temperature of about −160° C. at a pressure of usually 1 bar, to be compressed to a preferably variable final pressure in the range between 100 bar and 500 bar, preferably to a final pressure in the range between 210 bar and 350 bar. The advantage of such a reciprocating compressor is that natural gas can be drawn in and then compressed over a wide temperature range, preferably between −160° C. and +100° C. The compressor can be used to compress natural gas in a wide range of applications. For example, such a reciprocating compressor is capable of compressing an input fluid having a temperature of −160° C. to a compressed fluid having a temperature of −40° C. In this application, there is thus a temperature difference in the range of 120° C. between the input and output of the reciprocating compressor. To date, it is a great technical challenge to form a low-cost reciprocating compressor, especially a labyrinth piston compressor, suitable for compressing a fluid that has a high temperature difference between the input fluid and the output fluid.

Document US2012/0152110A1 discloses a reciprocating compressor having a cylinder, a piston, a carrier housing, a crosshead, and a crankshaft. This piston compressor has increased rigidity. Problems also occur with this reciprocating compressor when the inlet fluid and the outlet fluid have a high temperature difference.

SUMMARY

The task of the invention is to design a reciprocating compressor which is suitable for compressing a fluid despite a high temperature difference between the inlet and outlet, and which is economically advantageous.

The problem is solved in particular with a piston compressor comprising a cylinder and a piston arranged therein, a carrier housing with a crosshead mounted in the carrier housing, a spacer which connects the cylinder to the carrier housing, and a piston rod running in a longitudinal direction which connects the crosshead to the piston, wherein the spacer has a plurality of support arms, the support arms being connected to and supporting the cylinder.

The task is further solved in particular with a piston compressor comprising a cylinder and a piston arranged therein, a carrier housing with a crosshead mounted in the carrier housing, a spacer which connects the cylinder to the carrier housing, and a piston rod extending in a longitudinal direction which connects the crosshead to the piston, wherein the spacer comprises a plurality of support arms extending in the longitudinal direction, wherein the support arms are each individually connected to the cylinder towards the cylinder.

The task is further solved in particular with a method for operating a reciprocating compressor comprising a cylinder and a piston arranged therein, a carrier housing with a crosshead mounted in the carrier housing, a spacer which connects the cylinder to the carrier housing, and a piston rod extending in a longitudinal direction which connects the crosshead to the piston, wherein thermal energy, caused by a thermal difference present between the cylinder and the carrier housing, is exchanged via a plurality of support arms.

The task is further solved in particular with a method for operating a reciprocating compressor comprising a cylinder and a piston arranged therein, a carrier housing with a crosshead mounted in the carrier housing, a spacer which connects the cylinder to the carrier housing, and a piston rod extending in a longitudinal direction which connects the crosshead to the piston, wherein the spacer comprises a plurality of longitudinally extending support arms, wherein the support arms are each individually connected to the cylinder via attachment points, so that thermal energy, due to a thermal difference between the attachment points, is not directly exchanged in the circumferential direction to the longitudinal direction between the attachment points, but via the longitudinally extending support arms.

A labyrinth piston compressor comprises a piston as well as a cylinder, wherein at least the piston and the cylinder wall of the cylinder are formed a labyrinth seal. The labyrinth seal is a non-contact seal. The sealing effect is based on the extension of the flow path through the gap to be sealed, which significantly increases the flow resistance. The extension of travel is achieved by a surface structure of the piston and, if necessary, also of the cylinder wall. Preferably, the surface of the piston has a plurality of circumferential depressions that are spaced apart from one another in the longitudinal direction of the piston. Absolute tightness is not possible with this non-contact design. For this, the labyrinth piston compressor comprising the labyrinth seal has the advantage that the labyrinth seal is contactless because the piston and the cylinder wall do not touch each other, and therefore no lubrication is required between the piston and the cylinder wall. Such a labyrinth piston compressor allows a so-called oil-free compression of a fluid, because no lubricant, in particular no oil, is required to compress the fluid. The piston of such a labyrinth piston compressor has no sealing rings, as the labyrinth seal provides a seal.

The piston compressor according to the invention has the advantage that it can be operated safely even if the temperature of the fluid to be sucked in and the temperature of the compressed fluid to be discharged show a large temperature difference of, for example, 100° C. to 120° C. or even more. The piston compressor according to the invention is designed in such a way that the applied temperature differences do not result in any significant thermal stresses or any significant distortion of components of the piston compressor, or that the piston compressor is designed in such a way that an expansion of components of the piston compressor caused by the applied temperature difference takes place in such a way that the individual components are hardly displaced relative to each other due to the temperature difference, so that the piston compressor can be operated safely and reliably regardless of the applied temperature differences.

The piston compressor according to the invention has the advantage that the at least one inlet valve and the at least one outlet valve are arranged in the cylinder cover, which results in the advantage that a fluid to be compressed flows directly into the cylinder interior after flowing through the inlet valve, resp. that a compressed fluid leaves the cylinder interior immediately after flowing through the exhaust valve, so that the reciprocating compressor has an extremely small or no gas dead space or damage space within which a temperature transfer between fluid and reciprocating compressor could take place, so that the reciprocating compressor has relatively few contact surfaces which could exchange heat with the fluid. The piston compressor according to the invention thus preferably has, with the exception of the mandatory contact surfaces of the inflow of the fluid to be compressed, the compression of the fluid to be compressed and the discharge of the compressed fluid, negligibly small or no additional contact surfaces and contact points between the piston compressor and the fluid conveyed, which limits heat transfer between the fluid and the piston compressor. In addition, the cylinder and/or the piston of the reciprocating compressor is advantageously made of a metal with a thermal conductivity in the range between 100 and 300 (W/m·K), preferably aluminum or an aluminum alloy. The relatively high thermal conductivity means that during operation of the reciprocating compressor a temperature equilibrium is established in its components, the temperature differences of which are considerably smaller than the temperature differences between the inflowing and the compressed, outflowing fluid. Particularly advantageously, the cylinder and the piston are made of the same material.

The inlet valve and the outlet valve are also preferably arranged symmetrically in the cylinder with respect to a plane of symmetry extending along a centerline of the cylinder. As a result, during operation of the reciprocating compressor in the area of the symmetry plane, a mean temperature will be established which lies between the temperature of the inflowing fluid and the temperature of the outflowing fluid, which reduces maximum possible temperature differences occurring in the cylinder.

In a further advantageous embodiment, a flange or hose arranged at the inlet valve or outlet valve, which serve to supply or discharge the fluid, has a small contact area with respect to the cylinder, which in turn reduces heat transfer between the flange or hose and the cylinder. The flange or hose also has the advantage of being able to barrel The reciprocating compressor comprises a carrier housing, in which a crankshaft and at least one crosshead are preferably arranged. The piston compressor according to the invention comprises a spacer which is connected to the carrier housing and the cylinder in order, on the one hand, to keep the cylinder in a defined position with respect to the carrier housing and, on the other hand, to reduce any temperature flow between the cylinder and the carrier housing. In a particularly advantageous embodiment, the spacer is connected to the cylinder at those areas at which the mean temperature or essentially the mean temperature is applied. As a result, the temperature differences occurring at the spacer between the cylinder and the carrier housing during operation of the reciprocating compressor are kept within limits, with the spacer preferably being arranged in such a way that it has a heat distribution that is symmetrical to the plane of symmetry, which means that there is little or no distortion of the spacer due to the temperatures applied to the spacer. Thus, during operation of the piston compressor, in particular no or negligibly small asymmetrical thermal expansion or deformation occurs, but advantageously at most a thermal expansion or deformation symmetrical to the plane of symmetry due to the applied temperature, this effect occurring in particular at the cylinder, at the piston and at the spacer. Therefore, the piston rod running between the carrier housing and the cylinder does not undergo any deformation either.

In an advantageous embodiment, the cylinder and/or the piston are made of aluminum or an aluminum alloy, a metal that thus conducts heat very well. The very good heat conduction in turn has the advantage that during continuous operation of the reciprocating compressor, a mean temperature or an average operating temperature of the individual components of the compressor is established very quickly, thus avoiding temperature peaks.

The piston compressor according to the invention has the advantage that, in a preferred embodiment, it requires relatively few parts and that the moving parts can be selected to be relatively low in mass. This also gives the advantage that the piston compressor according to the invention can be operated at a high speed of, for example, up to 1800 rpm.

The reciprocating compressor according to the invention is explained in detail below by means of embodiment examples.

BRIEF DESCRIPTION OF THE DRAWINGS

The drawings used to explain the embodiments show.

In principle, the same parts are given the same reference signs in the drawings.

DETAILED DESCRIPTION

Figure 1:
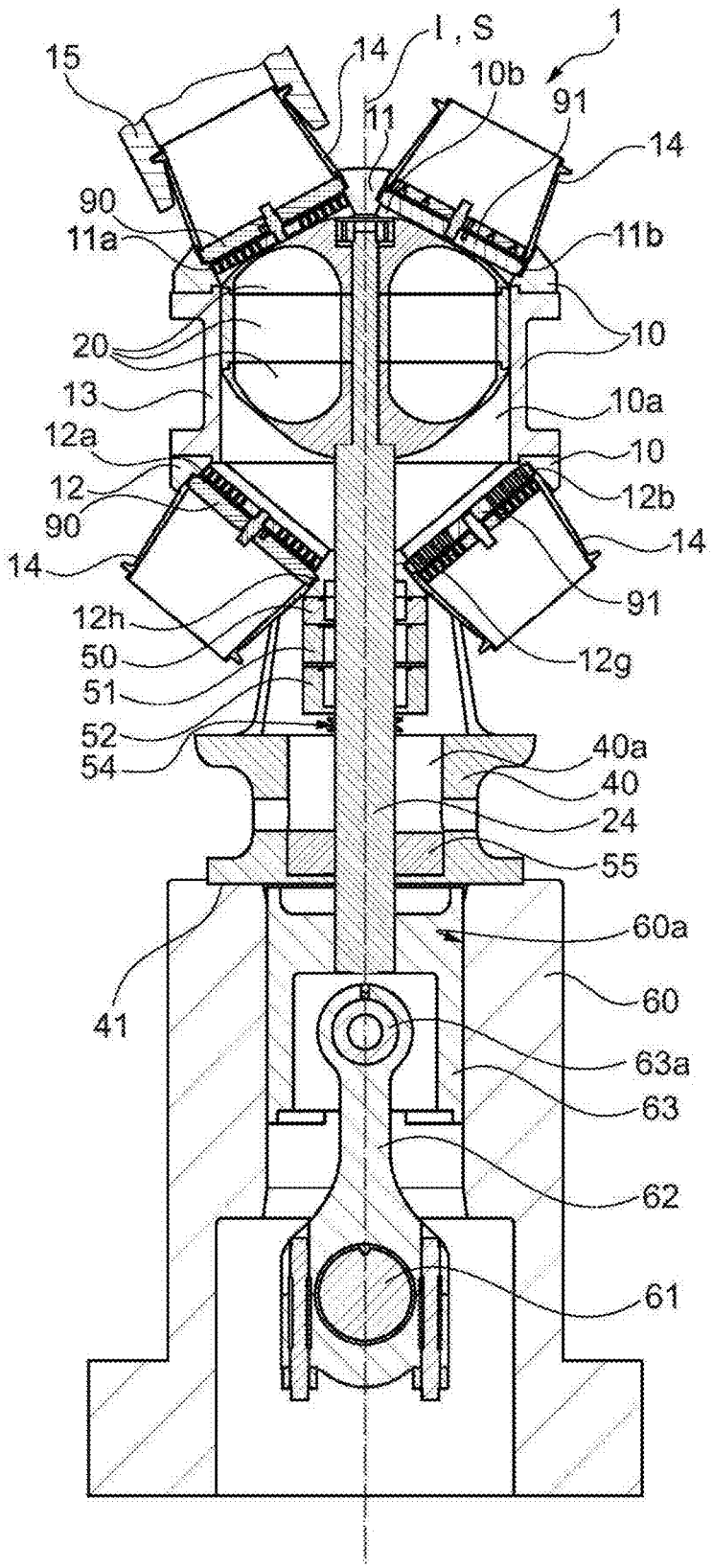
FIG. 1 a longitudinal section through a reciprocating compressor along section line A-A.

FIG. 1 shows a longitudinal section through a reciprocating compressor 1 comprising a cylinder 10 and a piston 20 arranged therein, comprising a carrier housing 60 with a crosshead 63 arranged therein with bearing part 63*a*, the crosshead 63 being drivable via a crankshaft 61 and a connecting rod 62, and comprising a spacer 40 with support section 41, the spacer 40 connecting the cylinder 10 to the carrier housing 60 and, as shown in FIG. 1, supporting the cylinder 10 when the reciprocating compressor 1 is arranged upright. The reciprocating compressor 1 includes a piston rod 24 that connects the crosshead 63 to the piston 20 and drives the piston 20. The reciprocating compressor 1 has a longitudinal axis 1 which extends along the center of the piston rod 24. The cylinder 10 includes a first cylinder cover 11, a second cylinder cover 12, and a cylinder jacket 13 disposed therebetween. The first cylinder cover 11 includes an intake valve receiving opening 11*a* and an exhaust valve receiving opening 11*b*, in which an intake valve 90 and an exhaust valve 91 are disposed, respectively. In addition, a flange 14 is connected to each of the openings 11*a*, 11*b*, the flange 14 being used to supply or remove a fluid between outside the cylinder 10 and an interior 10*a* of the cylinder 10. Fluids can be supplied or removed, for example, via a hose 15 connected to the respective flange 14. The second cylinder cover 12 also comprises an intake valve receiving opening 12*a* and an exhaust valve receiving opening 12*b* with intake valve 90 and exhaust valve 91 arranged therein, respectively. The second cylinder cover 12 comprises a central portion 12*h* having a passage opening 12*g* in which the piston rod 24 is arranged movably in the direction L of its travel. The cylinder 10 or the piston 20 is double-acting, in which the piston 20 defines a first cylinder interior 10*a* and a second cylinder interior 10*b*. In another embodiment, the cylinder jacket 13 could be dispensed with by making the first and second cylinder covers 11, 12 longer in the longitudinal direction L.

In the longitudinal direction L, a first, a second and a third stuffing box chamber 50, 51.52 are arranged downstream of the center section 12*h*. The first, second and third stuffing box chamber 50, 51.52 are arranged downstream of the center section 12. The spacer 40 has a spacer interior 40*a* in which an oil scraper packing 55, shown only schematically, is arranged, preferably comprising a guide which encloses the piston rod 24. In addition, an oil screen 54 is arranged on the piston rod 24. The support housing 60 includes a bore 60*a* that forms a sliding surface for the crosshead 63 so that the crosshead 63, the piston rod 24 connected to the crosshead 63, and the piston 20 connected to the piston rod 24 can reciprocate in the longitudinal direction L. Preferably, the sliding surface for the crosshead is lubricated, preferably with oil, although this lubrication is not shown in detail.

The cylinder 10 and/or the piston 20, and preferably also the carrier housing 60 and the crosshead 63, are made of a metal having a thermal conductivity in the range of preferably between 100 and 300 (W/m·K), preferably aluminum or an aluminum alloy. Advantageously, the cylinder 10 and the piston 20, and preferably also the carrier housing 60 and the crosshead 63, are made of the same material so that they have the same properties with regard to thermal expansion.

Figure 2:
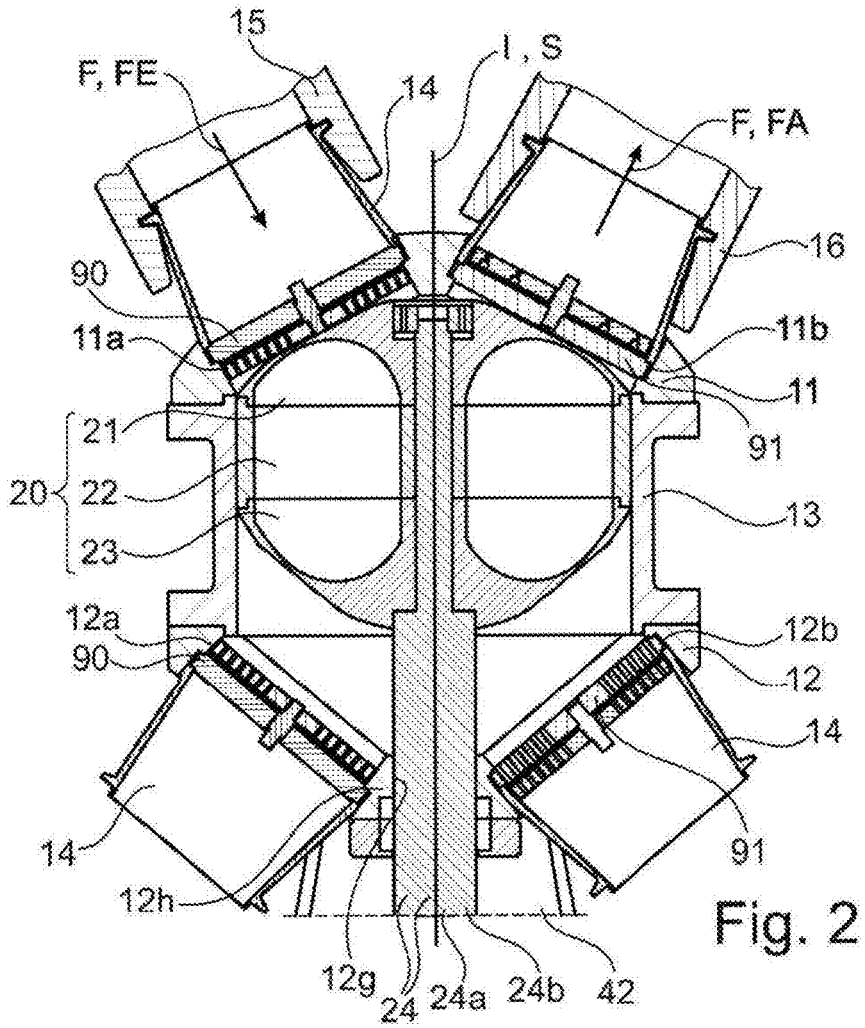
FIG. 2 a detailed view of the piston compressor according to FIG. 1, in particular the cylinder and the piston.

FIG. 2 shows a detailed view of the piston compressor 1 according to FIG. 1, essentially the cylinder 10, the piston 20, the flanges 14 and the inlet and outlet valves 90, 91. In one possible embodiment, the cylinder 10 and the piston 20 are single-acting in that, for example, only one inlet valve 90 and one outlet valve 91 are arranged in the first cylinder cover 11. Particularly advantageously, however, the cylinder 10 and the piston 20 are of double-acting design, as shown in FIG. 2, with a first cylinder interior 10*a*, a second cylinder interior 10*b* and two inlet valves 90 and two outlet valves 91. According to the invention, an inlet valve 90 and an outlet valve 91 are thus arranged at least in the first cylinder cover 11 or in the second cylinder cover 12, and preferably an inlet valve 90 and an outlet valve 91 are arranged in each of the two cylinder covers 11, 12, as shown in FIG. 2. In the respective cylinder cover 11, 12, the inlet valve 90 and the outlet valve 91 are arranged symmetrically with respect to a plane of symmetry S extending in the longitudinal direction L along the piston rod 24. Preferably, both inlet valves 90 and both exhaust valves 91 are arranged on the same side of the cylinder 10 as shown in FIG. 2, i.e. both to the left and both to the right of the plane of symmetry S, respectively, as shown in FIG. 2.

The reciprocating compressor according to the invention is particularly suitable for compressing a fluid whose inlet fluid FE flowing in via the inlet valve 90 and whose outlet fluid FA flowing out via the outlet valve 91 have a high temperature difference of, for example, between 100° C. to 150° C. For example, the inlet fluid FE, for example exhaust gas of liquefied natural gas, may have a temperature of −160° C., and the outlet fluid FA may have a temperature of −40° C., so that it has a temperature difference of 120° C. The symmetrical arrangement of inlet valve 90 and exhaust valve 91 with respect to the plane of symmetry S has the advantage that the cylinder 10 as well as the piston 20 assume an average temperature during operation in the region of the plane of symmetry S and the longitudinal axis 1 extending along the piston rod 24, respectively, the temperature of the cylinder 10 and of the piston 20 perpendicular to the longitudinal axis 1 usually decreasing towards the inlet valve 90 and increasing towards the exhaust valve 91. In the direction of the longitudinal axis 1, the cylinder 10 preferably exhibits only small temperature differences. Since the cylinder 10 and the piston 20 have an average temperature in the area of the longitudinal axis 1 during operation, the cylinder 10, the piston 20 and the piston rod 24 experience no or negligible distortion caused by temperature differences in these parts or changes in length caused by temperature differences. In an advantageous embodiment, the cylinder 10 and/or the piston 20 are made of a material with good thermal conductivity, for example aluminum, which gives the advantage of reducing the temperature differences applied to the cylinder 10 and the piston 20 during operation.

The piston compressor according to the invention is advantageously operated at ambient temperature. If the reciprocating compressor according to the invention is used to compress exhaust gas from liquid natural gas, the outer surface of the cylinder 10 is heated with air at ambient temperature, which further reduces temperature differences applied to the cylinder 10, especially if the cylinder 10 or at least the cylinder covers 11, 12 are made of a material that conducts heat well.

In a reciprocating compressor 1, a gas space is understood to be the space between a fluid supply line 15 and the inlet valve 90 or the space between the outlet valve 91 and a fluid discharge line 16. The piston compressor 1 according to the invention advantageously has no or a very small gas space, in that the fluid supply line 15 or a flange 14 is arranged in the fluid flow direction F directly upstream of the inlet valve 90, via which the fluid is supplied to the cylinder 10 from the outside, or in that a fluid discharge line 16 or a flange 14 is arranged in the fluid flow direction F directly downstream of the outlet valve 91, via which the fluid is discharged from the cylinder 10 to the outside. Thus, the pumped fluid is no longer in direct heat-conducting contact with the cylinder 10 until immediately upstream of the inlet valve 90 or immediately downstream of the outlet valve 91. As a result, the cylinder 10 is cooled to a lesser depth.

Figure 3:
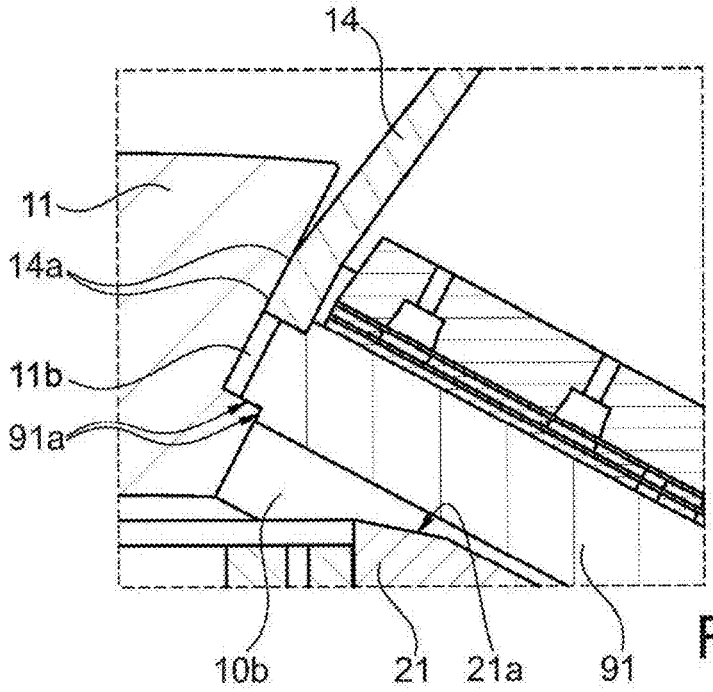
FIG. 3 a detailed view of the arrangement of the valve in the cylinder.

In a further advantageous embodiment, at least one of the components inlet valve 90, outlet valve 91 and flange 14 are designed in such a way that they have an increased thermal resistance to the cylinder cover 11, 12 in order to extract heat from the cylinder cover 11, 12 only to a reduced extent due to the cool fluid flowing through the inlet valve 90, the outlet valve 91 and/or the flange 14. FIG. 3 shows a detailed view of an embodiment for increasing the thermal resistance. The exhaust valve 91 is not in full contact with the first cylinder cover 11 but only over part of its surface 91*a*, which increases the thermal resistance between the exhaust valve 91 and the first cylinder cover 11. In the same way, the inlet valve 90 could also be arranged in the first or second cylinder cover 11, 12. As shown in FIG. 3, another possibility for increasing the thermal resistance is that the flange 14 is also not in full contact with the first cylinder cover 11 but only over part of its surface 14*a*, which increases the thermal resistance between the flange 14 and the first cylinder cover 11. In the same way, the flange 14 could also be arranged in the second cylinder cover 12. The reciprocating compressor 1 according to the invention is advantageously operated at ambient temperature, so that the cylinder 10 is heated by the ambient air during the conveying and compression of, for example, exhaust steam gas, whereby the increase in thermal resistance described above results in the advantage that the cylinder 10 is cooled to a reduced extent due to the fluid F flowing through it, so that the cylinder 10 has a higher temperature during operation and preferably also a more uniform temperature distribution, which reduces, for example, the risk of warping of the components of the reciprocating compressor 1 due to the applied temperature differences, in particular warping of the cylinder 10, the piston 20, the piston rod 24 or the spacer 40.

In an advantageous embodiment, the inner surface of the first or second cylinder cover 11, 12 and the outer surface of the first or second piston cover 21, 22 are designed to match each other in such a way that the so-called damage space remains as small as possible.

As shown in FIGS. 2 and 3, in an advantageous embodiment at least one of the two piston covers 21, 22 has a piston end face 21*a*, 22*a* which projects towards the associated cylinder cover 11, 12 and is in particular convex, the associated cylinder cover 11, 12 having a correspondingly projecting cylinder cover outer face 11*c*, 12*c* or a cylinder cover inner face 11*d*, 12*d* which recedes correspondingly with respect to the piston end face 21*a*, 22*a*. In the uppermost position of the piston 20, the first cylinder interior space 10*a* corresponds to the damage space, which is very small, as shown in FIG. 3.

In one possible embodiment, the first cylinder cover 11 and/or the second cylinder cover 12 could have an end face extending perpendicular to the longitudinal axis 1, in which the inlet valve 90 as well as the outlet valve 91 are arranged. Particularly advantageously, however, the first cylinder cover 11 and/or the second cylinder cover 12 are designed as shown in FIG. 2 in such a way that the inlet valve 90 and the outlet valve 91 are arranged in the cylinder cover 11, 12 so as to be inclined with respect to the plane of symmetry S. The inlet valve 90 and the outlet valve 91 are arranged in the cylinder cover 11, 12 so as to be inclined with respect to the plane of symmetry S. This allows to use valves 90, 91 with larger diameter, which reduces their flow resistance.

Figure 4:
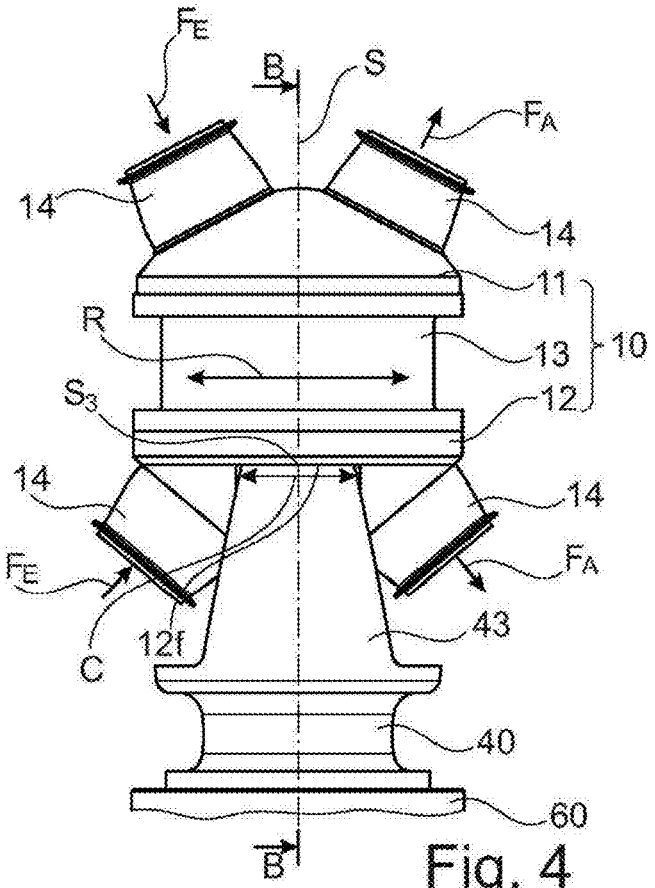
FIG. 4 a side view of the cylinder with spacer.
Figure 5:
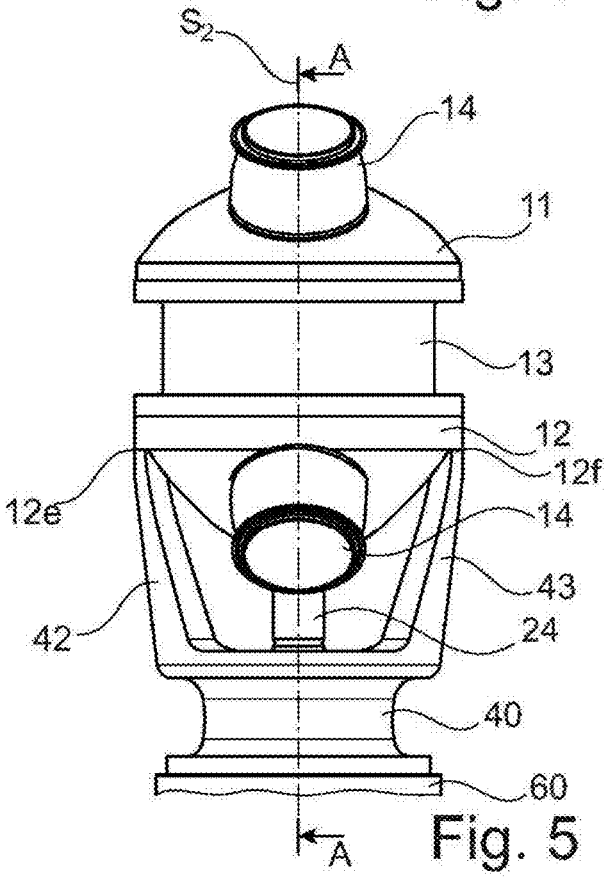
FIG. 5 another side view of the cylinder with spacer.

FIGS. 4 and 5 show the same cylinder 10 as in FIG. 2, but in two different side views rather than in a sectional view. The cylinder 10 comprises the first cylinder cover 11, the cylinder jacket 13 and the second cylinder cover 12. Flanges 14 are arranged in the cylinder covers 11, 12. The cylinder 10 is fixedly connected to the carrier housing 60 by a spacer 40 and is spaced with respect to the carrier housing 60. In the illustrated embodiment, the spacer 40 comprises two support arms 42, 43 arranged symmetrically with respect to the plane of symmetry S. and the second cylinder cover 12 comprises two attachment points 12*e*, 12*f*, each of which is fixedly connected to a support arm 42, 43. Each of the two attachment points 12*e*, 12*f* is preferably identical in the circumferential direction and has a width C in the range of preferably between 10° and 30° in the circumferential direction, as shown in FIG. 4. FIG. 4 also shows the course of the intersection line B-B and the course of the symmetry plane S. FIG. 5 also shows the course of the intersection line A-A and the course of the second symmetry plane S2. The attachment points 12*e*, 12*f* preferably run essentially perpendicular to the plane of symmetry S, as shown in FIG. 4 with attachment point 12*f*, and are arranged to run symmetrically with respect to the plane of symmetry S. The point S3 shows the intersection of the attachment point 12*f* with the symmetry plane S. The attachment point 12*f* preferably runs symmetrically with respect to the point S3 or symmetrically with respect to the plane of symmetry S. As already described, the cylinder 10 has an average temperature in the region of the plane of symmetry S or in the region of point S3 during operation of the reciprocating compressor 1. Due to the symmetrical arrangement, the same temperature is present at both attachment points 12*e*, 12*f*, or the cylinder 10 has the same temperature, so that the first support arm 42 and the second support arm 43 also have the same temperature at the two attachment points 12*e*, 12*f*. The symmetrical design of the cylinder 10 and the flanges 14 attached to the cylinder 10, as well as the symmetrical arrangement of the two attachment points 12*e*, 12*f*, and the symmetrically designed support arms 42, 43 of the spacer 40 resulted in the advantage that the support arms 42, 43 have the same temperature at the two attachment points 12*e*, 12*f*, so that no mutual thermal distortion occurs at the two support arms 42, 43. As already described, the input fluid FE and the output fluid FA can have a considerable temperature difference, so that the corresponding flanges 14 and also the cylinder 10 and possibly the piston 20 can have a temperature difference in the direction of flow C, which could possibly lead to distortion of the cylinder or distortion of its components, in particular in the direction of flow C. However, such distortion has no or negligible influence on the point S3 or on the support arms 42, 43, so that the cylinder 10 is held in a defined position by the spacer 40 during operation of the reciprocating compressor 1. Particularly important is the aspect that the piston rod 24 also passes through the passage opening 12*g* of the second valve cover 12 in the region of the plane of symmetry S, a region of the valve cover 12 which also has an average temperature, so that no or only very slight thermally induced distortion should also occur between the passage opening 12*g* and the piston rod 24.

In FIG. 5, the spacer 40 is U-shaped, comprising a first support arm 42 and a second support arm 43. However, the spacer 40 could also have more support arms, for example four, six or eight, which are connected to the second cylinder cover 12, and which are preferably arranged symmetrically with respect to the symmetry plane S. For better illustration, the second stuffing box chamber 51 and the third stuffing box chamber 52 as well as the spacer cover 53 are not shown in FIG. 5.

Figure 6:
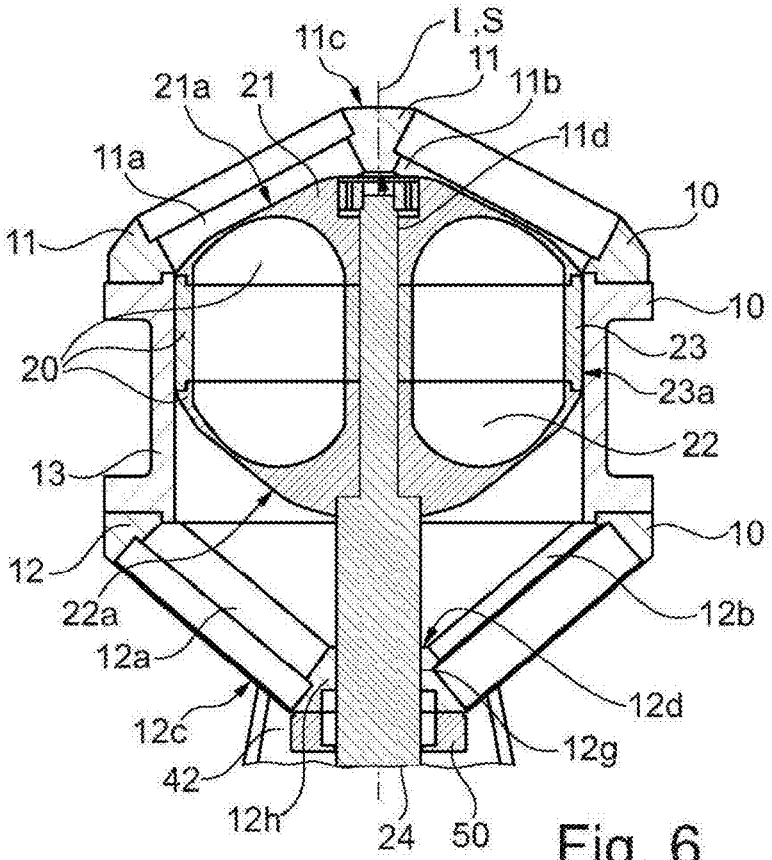
FIG. 6 a longitudinal section through the cylinder with piston along section line A-A.
Figure 7:
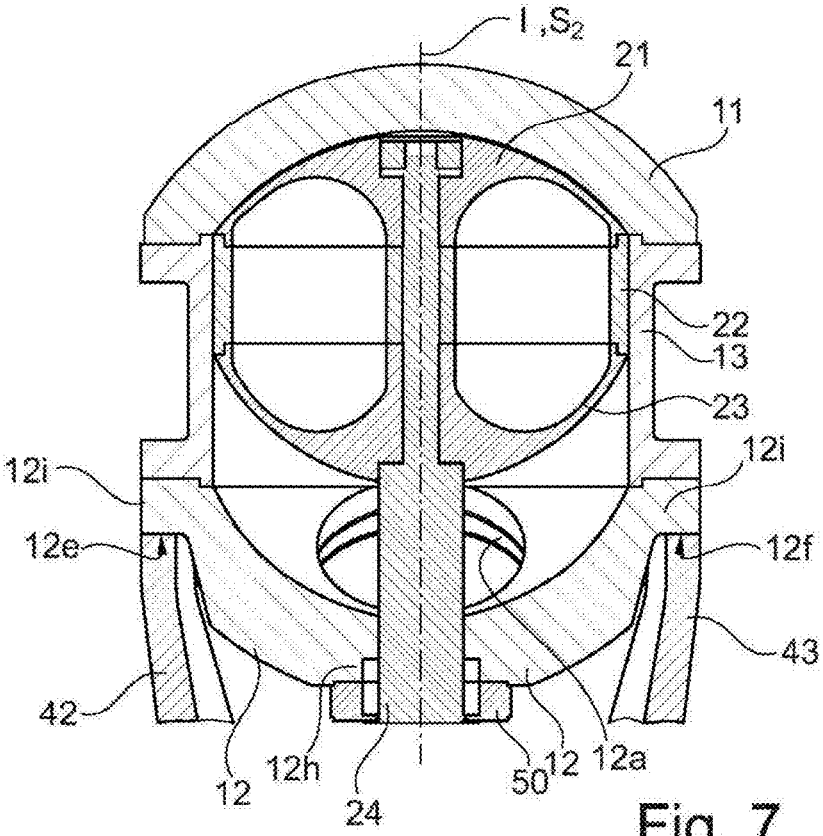
FIG. 7 another longitudinal section through the cylinder with piston along section line B-B.

FIG. 6 shows substantially the cylinder 10 and the piston 20 without the flanges 14 in a section along section line A-A. FIG. 7 shows substantially the cylinder 10 and the piston 20 without the flanges 14 in a section along the line of intersection B-B.

The cylinder 10 comprises at least three parts, the first cylinder cover 11, the second cylinder cover 12 and a preferably tubular cylinder jacket 13, wherein the cylinder jacket 13 is arranged between the first cylinder cover 11 and the second cylinder cover 13.

The piston 20 includes at least three parts, a first piston cap 21, a second piston cap 22, and a piston skirt 23 disposed between the first and second piston caps 21,22. This layered structure of cylinder and/or piston allows a particularly favorable maintenance, because on the occasion of the maintenance only those parts have to be replaced, which could show a considerable wear, for example the cylinder jacket 13 and the piston jacket 23. Advantageously the piston jacket 23 has at least partly a labyrinth-shaped outer surface 23*a*, so that the piston compressor 1 is designed as a labyrinth piston compressor. In a further advantageous embodiment, instead of the labyrinthine outer surface 23*a*, at least one sealing ring is arranged on the piston skirt 23, the piston skirt 23 preferably having at least one circumferential groove in which the sealing ring is arranged, so that the piston compressor 1 is designed as a ring-sealed piston compressor 1.

The second cylinder cover 12 has attachment points 12*e*, 12*f*, preferably arranged on its outer edge 12*i*, to which the support arms 42, 43 are fastened by a fastening means not shown, preferably a screw. The attachment points 12*e*, 12*f* are preferably mutually symmetrical with respect to the plane of symmetry S.

In an advantageous embodiment, at least one of the two piston covers 21, 22 has a piston end face 21*a*, 22*a* which projects towards the associated cylinder cover 11, 12 and is convex in particular, the associated cylinder cover 11, 12 having a correspondingly projecting cylinder cover outer face 11*c*, 12*c* or a cylinder cover inner face 11*d*, 12*d* which recedes correspondingly with respect to the piston end face 21*a*, 22*a*, as shown for example in FIG. 2.

The second cylinder cover 12 has in its center a passage opening 12*g* extending in longitudinal direction L, along which the piston rod 24 extends, wherein preferably in longitudinal direction L downstream of the passage opening 12*g*, outside the cylinder cover 12, at least one stuffing box chamber 50 is arranged and preferably a plurality of stuffing box chambers are arranged.

In an advantageous embodiment of the reciprocating compressor, at least one of inlet valve 90, outlet valve 91 and flange 14 is not in contact with the first or second cylinder cover 11,12 with the entire possible surface area, but is only in contact with the first or second cylinder cover 11,12 with a partial surface area, i.e. with a part of the possible total surface area, in order to increase the thermal resistance between inlet valve 90, outlet valve 91, flange 14 and first or second cylinder cover 11,12.

Figure 8:
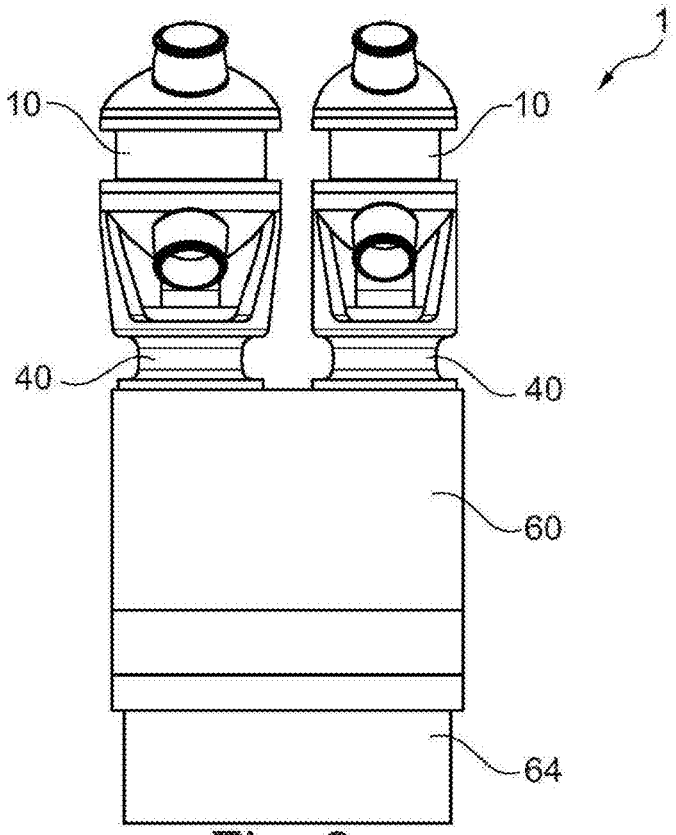
FIG. 8 a side view of the reciprocating compressor.

FIG. 8 shows a side view of piston compressor 1. This comprises two cylinders 10 with pistons 20 disposed therein, each piston 20 being connected to the carrier housing 60 by a spacer 40, and each piston rod 24 being driven by a common crankshaft 61. An oil collection pan 64 is located below the carrier housing 60. In further advantageous embodiments, the reciprocating compressor 1 may also comprise only a single cylinder 10 with piston 20, or a plurality of cylinders 10 with corresponding piston 20, for example between three to ten cylinders 10.

Figure 9:
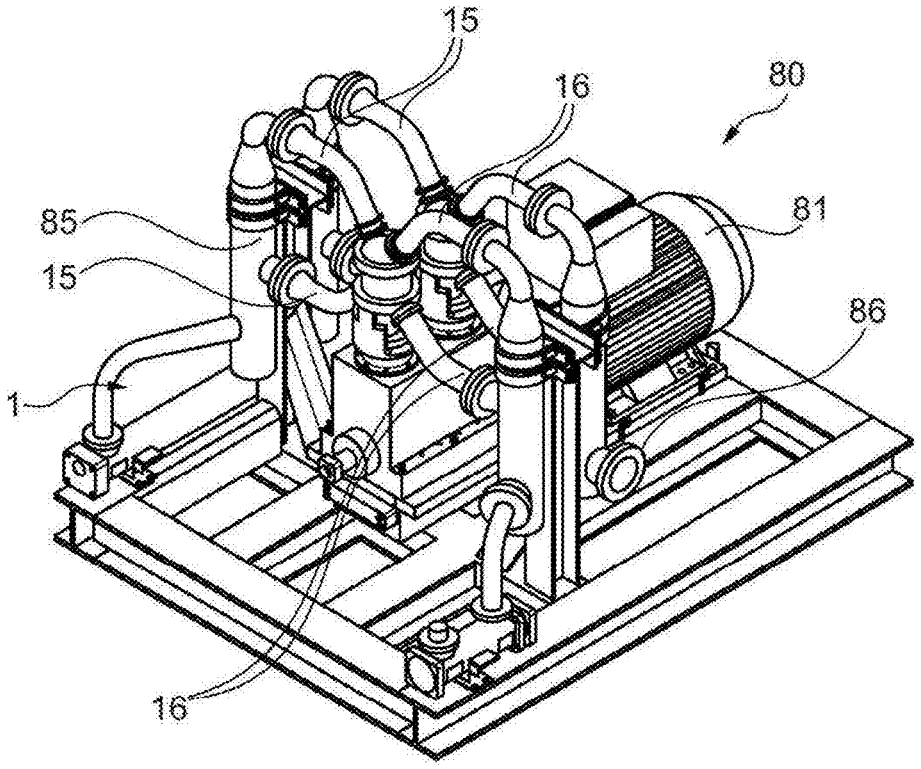
FIG. 9 the piston compressor in an application configuration.

FIG. 9 shows a compressor unit 80 comprising a reciprocating compressor 1, an electric motor 81, a supply manifold 85 connected to the fluid supply line 15, and a discharge manifold 86 connected to the fluid discharge line 16. The fluid supply line 15 as well as the fluid discharge line 16 are preferably designed to be elastic in order to compensate for temperature-related expansions, whereby these lines 15, 16 consist of a metal mesh, for example.

In an advantageous embodiment, the reciprocating compressor 1 comprises a cylinder 10 and a piston 20 disposed therein, a carrier housing 60 having a crosshead 63 mounted in the carrier housing 60, a spacer 40 connecting the cylinder 10 to the carrier housing 60, and a piston rod 24 extending in a longitudinal direction L and connecting the crosshead 63 to the piston 20, the spacer 40 comprising a plurality of support arms 42, 43, the support arms 42, 43 being connected to and supporting the cylinder 10. Advantageously, the cylinder 10 comprises a plurality of attachment points 12*e*, 12*f* mutually symmetrically arranged with respect to the longitudinal axis 1, to which the support arms 42, 43 are fastened. The piston compressor has a plane of symmetry S extending in the longitudinal direction L along the piston rod 24, the attachment points 12*e*, 12*f* and the support arms 42, 43 being arranged symmetrically with respect to the plane of symmetry S. Advantageously, the spacer 40 is U-shaped, with two support arms 42, 43 extending in the longitudinal direction L, the cylinder 10 having two attachment points 12*e*, 12*f* to which the support arms 42, 43 are attached. Advantageously, each attachment point 12*e*, 12*f* has a width C in the range between 10° and 30° in the circumferential direction of the cylinder 10. Advantageously, the cylinder 10 comprises an inlet valve 90 and an outlet valve 91, the inlet valve 90 and the outlet valve 91 being mutually symmetrical with respect to the plane of symmetry S. Advantageously, the cylinder 10 comprises a first cylinder cover 11 as well as a second cylinder cover 12, wherein both the first and the second cylinder cover 11,12 comprise an inlet valve 90 as well as an outlet valve 91, so that the cylinder 10 and the piston 20 are double-acting. Advantageously, a plurality of cylinders 10 with pistons 20 arranged therein are mutually spaced on the carrier housing 60 and are each connected to the carrier housing 60 via a separate spacer 40. Advantageously, a piston rod 24 is assigned to each piston 20, the carrier housing 60 being designed as a monoblock, and the monoblock having a number of bores corresponding to the number of piston rods 24, in each of which a crosshead 63 is displaceably mounted, each piston 20 being connected to the assigned crosshead 63 via a piston rod 20 in each case. Advantageously, the monoblock and the crosshead 62 are made of a metal with a thermal conductivity in the range between 100 and 300 (W/m·K), preferably aluminum or an aluminum alloy. Preferably, the cylinder 10 and/or the piston 20 is made of a metal having a thermal conductivity in the range between 100 and 300 (W/m·K), preferably aluminum or an aluminum alloy.

The piston compressor 1 comprising a cylinder 10 and a piston 20 arranged therein, a carrier housing 60 with a crosshead 63 mounted in the carrier housing 60, a spacer 40 which connects the cylinder 10 to the carrier housing 60, and a piston rod 24 extending in a longitudinal direction L and connecting the crosshead 63 to the piston 20, is advantageously operated in such a way that thermal energy, caused by a thermal difference present between the cylinder 10 and the carrier housing 60, is exchanged via a plurality of support arms 42, 43. Advantageously, an inlet fluid FE is supplied to the cylinder 10 via an inlet valve 90, and the fluid located in the cylinder 10 is expelled from the cylinder 10 via an outlet valve 91 as an outlet fluid FA, wherein the inlet valve 90 and the outlet valve 91 are arranged symmetrically with respect to a plane of symmetry S extending along the longitudinal direction L of the piston rod 24, so that the cylinder 10 is heated during the conveyance of the fluid in the region of the plane of symmetry S to a mean temperature which lies between the temperature of the inlet fluid FE and the outlet fluid FA, the support arms 42, 43 being connected to the cylinder 10 in the region of the plane of symmetry S via attachment points 12*c*, 12*f*. Advantageously, the two center points S3 between the attachment points 12*c*, 12*f* are tempered to essentially the same temperature while the fluid is being conveyed. Advantageously, the piston rod 24 extends in the region of the plane of symmetry S, and this is tempered to substantially the same temperature as the attachment points 12*e*, 12*f* while the fluid is being conveyed.

The piston compressor 1 shown in FIG. 1 comprises a cylinder 10 and a piston 20 arranged therein, a carrier housing 60 with a crosshead 63 mounted in the carrier housing 60, a spacer 40 which connects the cylinder 10 to the carrier housing 60, and a piston rod 24 which extends in a longitudinal direction L and connects the crosshead 63 to the piston 20, the spacer 40 comprising a plurality of support arms 42, 43 extending in the longitudinal direction L, the support arms 42, 43 each being individually connected to the cylinder 10 towards the cylinder 10.

The cylinder 10 has a plurality of attachment points 12*e*, 12*f*, with one support arm 42, 43 attached to each of the attachment points 12*e*, 12*f*.

The attachment points 12*e*, 12*f* are arranged symmetrically with respect to each other in the longitudinal direction L.

The compressor according to the invention can be designed as a labyrinth piston compressor or as a compressor comprising at least one piston with sealing rings.

The method of operating a reciprocating compressor 1 includes a cylinder 10 and a piston 20 disposed therein, a carrier housing 60 having a crosshead 63 supported in the carrier housing 60, a spacer 40 connecting the cylinder 10 to the carrier housing 60, and a piston rod 24 extending in a longitudinal direction L and connecting the crosshead 63 to the piston 20, wherein the spacer 40 includes a plurality of support arms 42 extending in a longitudinal direction L,43, wherein the support arms 42, 43 are each individually connected to the cylinder 10 via attachment points 12*e*, 12*f*, so that thermal energy, due to a thermal difference present between the attachment points 12*e*, 12*f*, is not exchanged directly in the circumferential direction with respect to the longitudinal direction L between the attachment points 12*e*, 12*f*, but is exchanged via the support arms 42, 43 extending in the longitudinal direction L.

In the method, the inlet fluid FE is preferably supplied at a temperature in the range between −162° C. and −40° C., and the outlet fluid FA is preferably heated by a temperature difference in the range between 100° C. and 150° C. due to compression.

During the method, the attachment points 12*e*, 12*f* each have a center point S3 in the region of the plane of symmetry S, which are tempered to essentially the same temperature while the fluid is conveyed.

In the method, the spacer 40 is U-shaped with a support section 41 and two support arms 42, 43 extending in the longitudinal direction L, wherein thermal energy is exchanged between the cylinder 10 and the carrier housing 60 via the support arms 42, 43 and the support section 41.

In the method, each attachment point (12*e*, 12*f*) has a width C in the circumferential direction of the cylinder 10 in the range between 10° and 30°, each attachment point 12*e*, 12*f* being arranged symmetrically with respect to the center point S3 so that thermal energy is transferred in the circumferential direction from the respective support arm 42,43 along the attachment point 12*c*. 12*f*.

What is claimed is:

1. A method of operating a piston compressor, said piston compressor comprising a cylinder and a piston disposed therein, a carrier housing having a crosshead mounted in the carrier housing, a piston rod extending in a longitudinal direction (L), which connects the crosshead to the piston, an inlet valve and an outlet valve, and a spacer which connects the cylinder to the carrier housing, wherein the spacer comprises a plurality of support arms extending in the longitudinal direction (L), wherein the support arms are each individually connected to the cylinder towards the cylinder, wherein the cylinder has a plurality of attachment points, and wherein one support arm of the plurality of support arms is attached to one respective attachment point of the plurality of attachment points, the method comprising the steps:

a) supplying an inlet fluid (FE) at a temperature in the range between −162° C. and −40° C. to the cylinder via the inlet valve;

b) expelling the fluid located in the cylinder from the cylinder as an outlet fluid (FA) via the outlet valve, wherein the outlet fluid (FA) is heated in the cylinder by compression by a temperature difference in the range between 100° C. and 150° C.; wherein the cylinder is heated during the conveyance of the fluid to an average temperature which lies between the temperature of the inlet fluid (FE) and the outlet fluid ($F_A$), wherein thermal energy, due to a thermal difference between the attachment points, is not exchanged directly in the circumferential direction relative to the longitudinal direction (L) between the attachment points, but via the support arms extending in the longitudinal direction (L).

2. The method according to claim 1, wherein the inlet valve and the outlet valve are arranged symmetrically with respect to a plane of symmetry(S) extending along the longitudinal direction (L) of the piston rod, so that the cylinder is heated during the conveyance of the fluid in the region of the plane of symmetry(S) to an average temperature which lies between the temperature of the inlet fluid (FE) and the outlet fluid ($F_A$), and wherein the support arms are connected to the cylinder in the region of the plane of symmetry(S) via the attachment points.

3. The method according to claim 2, wherein the attachment points each have a center point $S_3$ in the region of the plane of symmetry(S), which are tempered to essentially the same temperature during the conveying of the fluid.

4. The method according to claim 1, wherein the spacer is U-shaped, with a support section and two of the support arms extending in the longitudinal direction (L), and the cylinder has two of the attachment points, each support arm of the two support arms are fastened to a respective attachment point of the two attachment points, wherein thermal energy is exchanged between the cylinder and the carrier housing via the support arms and the support section.

5. The method according to claim 3, wherein each of the attachment points has a width (C) in the circumferential direction of the cylinder in the range between 10° and 30°, wherein each of the attachment points is arranged symmetrically with respect to the center point $S_3$, and wherein thermal energy is transmitted in the circumferential direction from the respective support arm along the attachment point.

6. The method according to claim 1, wherein the piston rod extends in the region of the plane of symmetry(S) and is tempered to substantially the same temperature as the attachment points while the fluid is conveyed.

7. The method according to claim 1, wherein the attachment points are mutually symmetrically arranged with respect to the longitudinal direction (L).

8. The method according to claim 2, wherein the cylinder comprises a first cylinder cover as well as a second cylinder cover, and wherein the first cylinder cover comprises the inlet and the outlet valve, and the second cylinder cover comprises a second inlet valve as well as a second outlet valve, so that the cylinder and the piston are double-acting.

9. The method according to claim 1, wherein the spacer is a plurality of spacers; the cylinder is comprised of a plurality of cylinders, and the piston is comprised of a plurality of pistons, one of the pistons of the plurality of pistons arranged within a respective cylinder of the plurality of cylinders, each of the cylinders are arranged mutually spaced apart on the carrier housing and are each connected to the carrier housing via a separate spacer of the plurality of spacers.

10. The method according to claim 9, wherein the piston rod is comprised of a plurality of piston rods, a piston rod of the plurality of piston rods is assigned to each piston, wherein the carrier housing is designed as a monoblock, and wherein the monoblock has a number of bores corresponding to a number of piston rods; the crosshead is comprised of a plurality of crossheads, a crosshead of the plurality of crossheads is displaceably mounted in each bore, each piston of the plurality of pistons being connected to an assigned crosshead of the plurality of crossheads via a piston rod of the plurality of piston rods.

11. The method according to claim 10, wherein the carrier housing and each of the plurality of crossheads are made of a metal having a thermal conductivity in the range between 100 and 300 W/m·K.

12. The method according to claim 11, wherein the carrier housing and each of the plurality of crossheads are made of aluminum or an aluminum alloy.

13. The method according to claim 1, wherein at least one of the cylinder and the piston consists of a metal with a thermal conductivity in the range between 100 and 300 W/m·K.

14. The method according to claim 1, wherein the cylinder and the piston are made of aluminum or an aluminum alloy.

* * * * *